US006331001B1

(12) United States Patent
Sekiguchi

(10) Patent No.: US 6,331,001 B1
(45) Date of Patent: Dec. 18, 2001

(54) SHEET FEEDING MACHINE

(75) Inventor: Hideyuki Sekiguchi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/519,619

(22) Filed: Mar. 6, 2000

(30) Foreign Application Priority Data

Mar. 16, 1999 (JP) ..... 11-070379

(51) Int. Cl.[7] ..... B65H 3/44; B65H 5/26

(52) U.S. Cl. ..... 271/9.01; 271/117; 271/124; 271/10.1; 271/10.11; 271/145; 271/162; 271/167

(58) Field of Search ..... 271/9.01, 117, 271/124, 126, 10.11, 10.1, 145, 152, 153, 155, 162, 164, 157, 167

(56) References Cited

U.S. PATENT DOCUMENTS 4,991,830 * 2/1991 Yamanada ..... 271/117
5,454,554 * 10/1995 Boughton et al. ..... 271/9.01
5,642,877 * 7/1997 Green ..... 271/124
5,823,522 * 10/1998 Fujiwara et al. ..... 271/145
5,893,555 * 4/1999 Kawada et al. ..... 271/117
5,927,703 * 7/1999 Endo ..... 271/10.11

* cited by examiner

*Primary Examiner*—H. Grant Skaggs
(74) *Attorney, Agent, or Firm*—Kanesaka & Takeuchi

(57) ABSTRACT

A sheet feeding machine includes a sheet feeding table which is vertically movable and capable of supporting a plurality of first recording sheets thereon, first sheet feeding device movably situated above the sheet feeding table, the first sheet feeding device feeding the first recording sheets successively from a topmost sheet as the sheet feeding table with the first recording sheets moves upward, a base body detachably attached to the sheet feeding table, the base body supporting a plurality of second recording sheets thereon, and second sheet feeding device situated on the base body and feeding the second recording sheets successively from a bottommost sheet so that when the base body is attached to the sheet feeding table, the second recording sheet is fed by the second sheet feeding device and is transferred further by the first feeding device as a conveying device.

11 Claims, 11 Drawing Sheets

(a)

(b)

SHEET FEEDING MACHINE

BACKGROUND OF THE INVENTION

1. Field of the Invention

The present invention relates to a sheet feeding machine for use in a printer. The sheet feeding machine of the present invention is the detachable one that is optionally attached to a sheet feeding device of the printer. The sheet feeding machine of the present invention is useful for feeding special sheets except normal printing sheets.

2. Description of the Related Art

A conventional printer usually includes a sheet feeding machine for feeding printing sheets. For example, the sheet feeding machine has a vertically movable sheet feeding table for supporting many printing sheets thereon and sheet feeding means situated above the sheet feeding table. The sheet feeding means successively feeds the printing sheets to the printer from a topmost one as the feeding table moves upward.

In the sheet feeding machine of the conventional printer, use, thickness, quality and size of the printing sheet to be fed are limited. Generally, the only frequently-used types specified in industrial standards can be fed by the sheet feeding machine. The other types are not applicable to the machine. For example, a special card such as one comprising plural layers laminated with each other or one with its surface coated and an envelope are difficult to be stably conveyed into a printing section of the printer.

For example, the sheet feeding machine has a pick-up roller and a separating member contacted with each other to scrape the printing sheets one by one. Even if the printing sheets over two are fetched at one time, the pick-up roller and the separating member separate them from each other, so that the only one sheet is fed out. When the special cards mentioned before are fed by the sheet feeding machine, they sometimes suffer damage to a surface thereof by rubber of the separating member while passing between the pick-up roller and the separating member, or a front edge of the card may be soiled by the separating member. Further, the envelope has two different constitutions, one is that of a center portion where two sheets are superimposed on each other with air sandwiched therebetween, and the other is that of an end portion where a sheet is just bent. Thus, when the envelopes are superimposed and the pick-up roller feeds a topmost one while contacting therewith, a center portion of the envelopes are recessed while being pushed by the pick-up roller, so that a leading end portion thereof is levitated. The levitated leading end portion of the topmost envelope stops at the pick-up roller, and the envelope cannot be conveyed.

In this way, the sheet feeding machine equipped with the conventional printer cannot feed the special printing sheets stably due to occurrence of troubles such as pick-up failure, jam, damage to the sheets, levitation of the sheets, separating noise and misregistration.

The object of the present invention is to provide a sheet feeding machine capable of being detachably attached to the conventional sheet feeding machine for use in printing the special printing sheets.

SUMMARY OF THE INVENTION

A sheet feeding machine as defined in the first aspect of the present invention 1 includes a sheet feeding table which is vertically movable and capable of supporting a plurality of first recording sheets thereon, first sheet feeding device movably situated above the sheet feeding table, the first sheet feeding device feeding the first recording sheets successively from a topmost sheet as the sheet feeding table with the first recording sheets moves upward, a base body detachably attached to the sheet feeding table, the base body supporting a plurality of second recording sheets thereon, and second sheet feeding device situated on the base body and feeding the second recording sheets successively from a bottommost sheet so that when the base body is attached to the sheet feeding table, the second recording sheet is fed by the second sheet feeding means and is transferred further by the first feeding device as conveying means.

According to a sheet feeding machine as defined in the second aspect of the present invention, in the first aspect, said first sheet feeding device includes fetching device for fetching the first recording sheets and separating device situated adjacent to the fetching device for separating the topmost sheet from the first recording sheets fetched by the fetching device to feed the topmost sheet so that the fetching device moves upward to halt fetching and the separating device halts separating in the case where the first sheet feeding device is used as the conveying means.

According to a sheet feeding machine as defined in the third aspect of the present invention, in the first aspect, the first sheet feeding device includes a first roller for fetching the first recording sheets including the topmost sheet while contacting therewith, a second roller for separating the topmost sheet from the first recording sheets fetched by the first roller to feed the topmost sheet, and a separating member contacting the second roller, a contact condition of the separating member with the second roller being adjustable so that in the case where the first sheet feeding means is used as the conveying device, the first roller moves upward not to contact the second recording sheets on the base body and the separating member halts separating.

According to a sheet feeding machine as defined in the fourth aspect of the present invention, in the third aspect, the separating member is a first separating plate, an angle of the first separating plate relative to the second roller being adjustable, in the case where the first sheet feeding device is used as the conveying device, the first separating plate together with the second roller functions as the conveying device with the angle adjusted relatively small against a feeding direction of the second recording sheet in comparison with the case where the first sheet feeding device feeds the first recording sheets.

According to a sheet feeding machine as defined in the fifth aspect of the present invention, in the first aspect, the second sheet feeding device includes a separating roller partially protruding from a conveying surface on the base body for conveying the second recording sheet and a second separating plate vertically movably situated above the separating roller.

According to a sheet feeding machine as defined in the sixth aspect of the present invention, in the fifth aspect, the second separating plate has a separating surface made of a frictional material and curved outwardly toward the separating roller.

According to a sheet feeding machine as defined in the seventh aspect of the present invention, in the fifth aspect, a distance between the second separating plate and the separating roller is fairly larger than the thickness of the second recording sheet.

A sheet feeding machine as defined in the eighth aspect of the present invention, in the fifth aspect, further includes a supporting device situated on the base body for supporting the second recording sheets thereon so that the second recording sheets are spaced away from the conveying surface.

A sheet feeding machine as defined in the ninth aspect of the present invention, in the fifth aspect, further includes conveying mechanism for conveying the second recording sheet fed from the separating roller while being driven by in association with the separating roller, and pressing means situated vertically movably above the conveying mechanism for pressing the second recording sheet against the conveying mechanism with its self-weight.

A sheet feeding machine as defined in the tenth aspect of the present invention, in the fifth aspect, further includes a sensor situated adjacent to the sheet feeding table, the sensor outputting a stop signal for the sheet feeding table to stop while being operated by the first sheet feeding device moved by the first recording sheets stacked on the sheet feeding table when the sheet feeding table moves upwards so that the base body attached to the sheet feeding table is vertically positioned when a part of the base body moves the first sheet feeding device thereby operating the sensor as the sheet feeding table moves upwards.

A combination as defined in the eleventh aspect of the present invention comprises a main sheet feeding machine for feeding first recording sheets and a sub sheet feeding machine detachably attached to the main sheet feeding machine for feeding second recording sheets. The main sheet feeding machine includes a sheet feeding table which is vertically movable and capable of supporting the first recording sheets thereon, and first sheet feeding device situated above the sheet feeding table, the first sheet feeding device being capable of feeding the first recording sheets successively from a topmost sheet as the sheet feeding table with the first recording sheets stacked thereon moves upward. The sub sheet feeding machine includes a base body detachably attached to the sheet feeding table, the base body supporting the second recording sheets thereon, and second sheet feeding device situated on the base body and feeding the second recording sheets successively from a bottommost sheet so that when the base body is attached to the sheet feeding table, the first feeding device operates as a conveying device for conveying the second recording sheets fed by the second sheet feeding means.

BRIEF DESCRIPTION OF THE DRAWINGS

FIG. 10(*b*) is a view illustrating adjustment of tilt angle of a first separating plate of the separating means in the stencil printing machine.

DETAILED DESCRIPTION OF PREFERRED EMBODIMENTS

A first embodiment of the present invention will be explained with reference to FIGS. 1 to 10(*b*).

Figure 1:
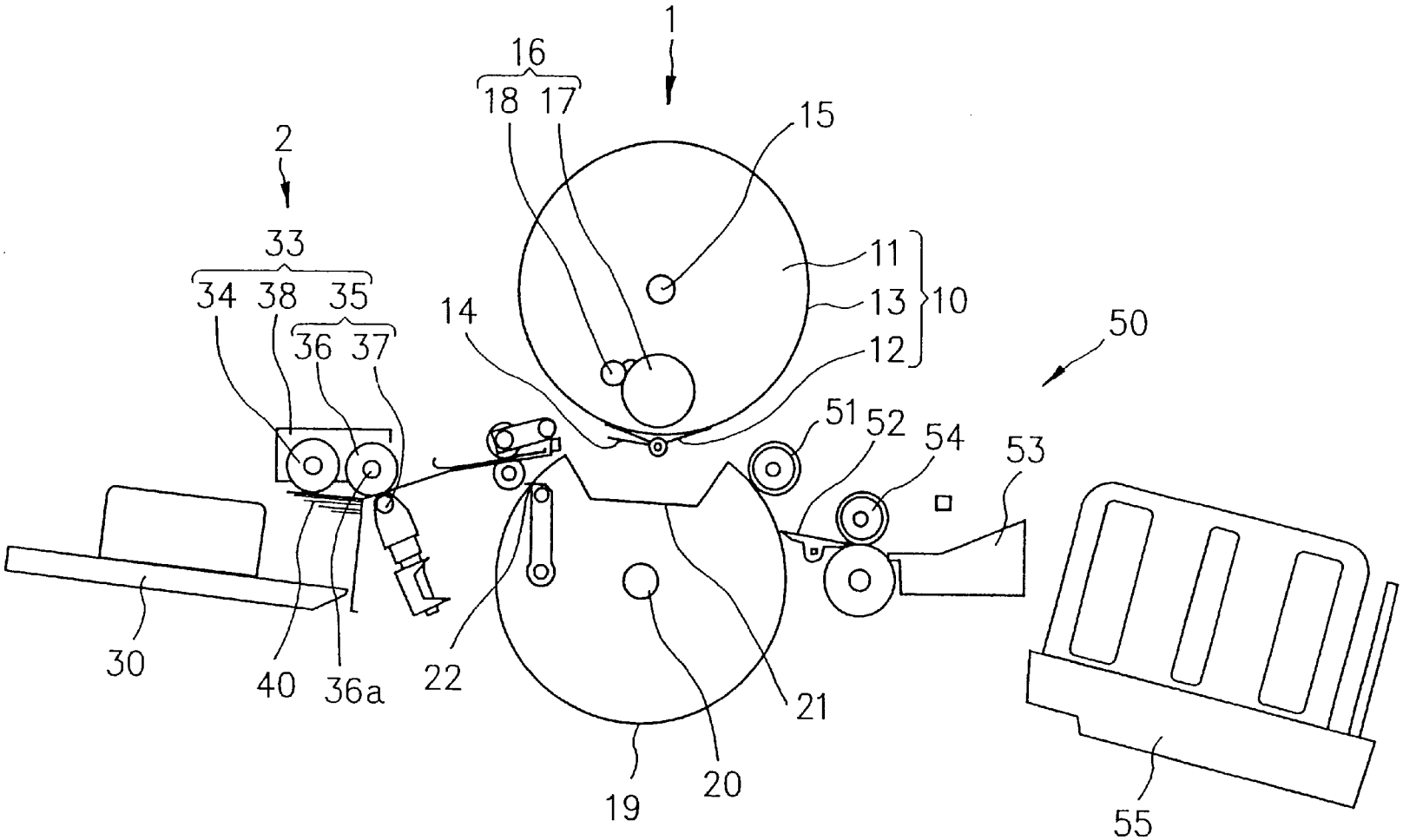
FIG. 1 is a schematic view showing structure of a stencil printing machine to which a sheet feeding machine of the present embodiment is attached.

A sheet feeding machine of the present embodiment is the detachable one that is optionally attached to a conventional sheet feeding machine equipped with a printing machine for use in feeding special printing sheets. In this embodiment, a sheet feeding machine of a stencil printing machine 1 shown in FIG. 1 is referred to as a main sheet feeding machine 2, and a unit type sheet feeding machine 3 of the present embodiment is used while being attached to the main sheet feeding machine 2. Further, in the present embodiment, both of the main sheet feeding machine and the sheet feeding machine feed recording medium. Especially, printing medium fed by the main sheet feeding machine is referred to as a printing sheet and the one fed by the sheet feeding machine 3 is referred to as a printing material. The printing sheet and the printing material should be distinguished from each other.

FIG. 1 is a schematic view showing structure of the stencil printing machine 1 to which the sheet feeding machine 3 of the present embodiment is attached. A printing drum 10 has two side plates 11 of disc-form arranged to be spaced at a predetermined distance away from each other and a rigid clamp base plate 12 connecting the side plates. Further, an ink-permeable and flexible circumferential wall 13 is wound around outer circumferential surfaces of the side plates 11. The circumferential wall 13 is formed by weaving wires such as stainless wires. The circumferential wall 13 is radially deformable.

A clamp plate 14 for detachably clamping a leading end portion of a stencil sheet is coupled to the clamp base plate 12. The stencil sheet is wound around the outer surface of the circumferential wall 13 while being held on the clamp base plate 12 at the leading end portion thereof by the clamp plate 14.

The printing drum 10 is rotatably supported on a central axis 15 of its own. The printing drum 10 is rotated by a driving mechanism in the anti-clockwise direction on FIG. 1.

Ink supplying means 16 is situated inside the printing drum 10. The ink supplying means 16 has an inside pusher roller 17 for supplying ink to an inner surface of the circumferential wall 13 and a doctor roller 13 for supplying ink to an outer circumferential surface of the inside pusher roller 17. The inside pusher roller 17 is parallel to the central axis 15 of the printing drum 10. The inside pusher roller 17 is vertically movable while being attached to a swinging drive mechanism not shown. And, the inside pusher roller 17 is driven to move vertically in synchronization with rotation of the printing drum 10. The inside pusher roller 17 pushes the inner circumferential surface of the circumferential wall 13 outwardly in printing time. The roller 17 leaves the inner circumferential surface of the circumferential wall 13 in non-printing time.

An opposing drum 19 is situated below the printing drum 10. The opposing drum 19 is rotatably supported by a center axis 20 of its own. An outer diameter of the opposing drum 19 is identical to that of the printing drum 10. The opposing drum 19 and the printing drum 10 are parallel to each other and arranged in a predetermined rotational phase. There is a predetermined distance between the opposing drum 19 and the printing drum 10 that is not outwardly deformed. The opposing drum 19 is driven to rotate in the clockwise direction in FIG. 1 by the driving mechanism for the printing drum 10 in synchronization with the rotation of the printing drum 10.

The opposing drum 19 has a recess 21 formed in an outer circumferential surface thereof As shown in FIG. 1, if the opposing drum 19 and the printing drum 10 are each positioned in respective rotating directions so that the recess 21 corresponds in angular position to the clamp plate 14, the clamp plate 14 does not collide with the opposing drum 19 when the opposing drum 19 and the printing drum 10 rotate. A claw 22 for holding a leading end of a printing sheet is openably attached to the outer circumferential surface of the opposing drum 19.

Figure 2:
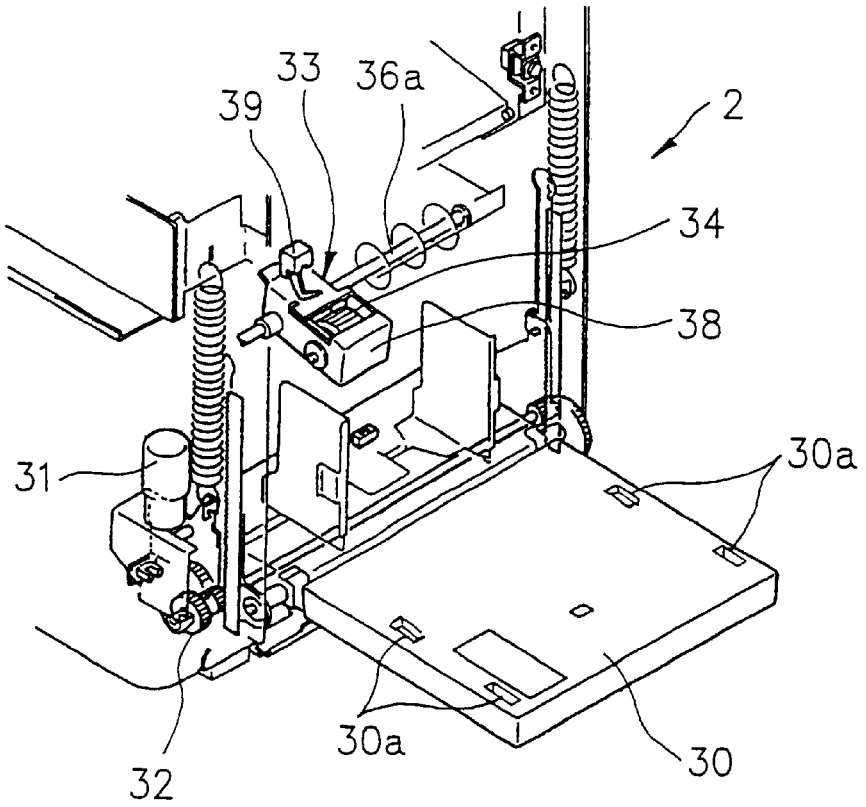
FIG. 2 is a perspective view illustrating a sheet feeding table of the stencil printing machine.

As shown in FIG. 1, the main sheet feeding machine 2 has a sheet feeding table 30 which moves vertically with the printing sheets stacked thereon. As shown in FIG. 2, the sheet feeding table 30 can move vertically while maintaining itself in a horizontal situation when being driven by a motor 31 and a driving mechanism 32 interlocking with the motor.

As shown in FIGS. 1 and 2, the main sheet feeding machine 2 has first sheet feeding means 33 situated above the sheet feeding table 30. The first sheet feeding means 33 feeds out the printing sheets one by one from the sheet feeding table 30.

As shown in FIG. 1, the first sheet feeding means 33 has a scraper roller 34, i.e. a first roller as fetching means for taking out the printing sheets from a topmost sheet and separating means 35 for separating and feeding out the printing sheets one by one. The separating means 35 of the present embodiment includes a pick-up roller 36 as a second roller and a first separating plate 37 contacting therewith as a separating member.

As shown in FIG. 1, a rotating axis of the scraper roller 34 is parallel to that of the pick-up roller 36, and the axes are attached to a common casing 38 made of sheet metal side by side. As shown in FIG. 2, the casing 38 and the scraper roller 34 are vertically swingable around a rotating axis 36*a* of the pick-up roller 36 in a predetermined range. Further, a positioning sensor 39 (switch) is situated above the casing 38. If the sheet feeding table 30 moves upward, the printing sheets on the sheet feeding table 30 contact the scraper roller 34. The scraper roller 34 and the casing 38 swing upward around the rotating axis 36*a* of the pick-up roller 36. The casing 38 moving upward operates the positioning sensor 39. The positioning sensor 39 outputs a signal, thereby halting vertical movement of the sheet feeding table 30. Then, the scraper roller 34 contacts an upper surface of the printing sheet 40 on the sheet feeding table 30. This is a regular position where the printing sheet 40 is fed out. At this position, the scraper roller 34 and the pick-up roller 36 are driven to rotate by not-shown driving means at predetermined timing. When the printing sheet numbers are decreased by feeding-out, the sheet feeding table 30 moves upward so that the topmost printing sheet 40 is positioned to the regular position for feeding.

Figure 3:
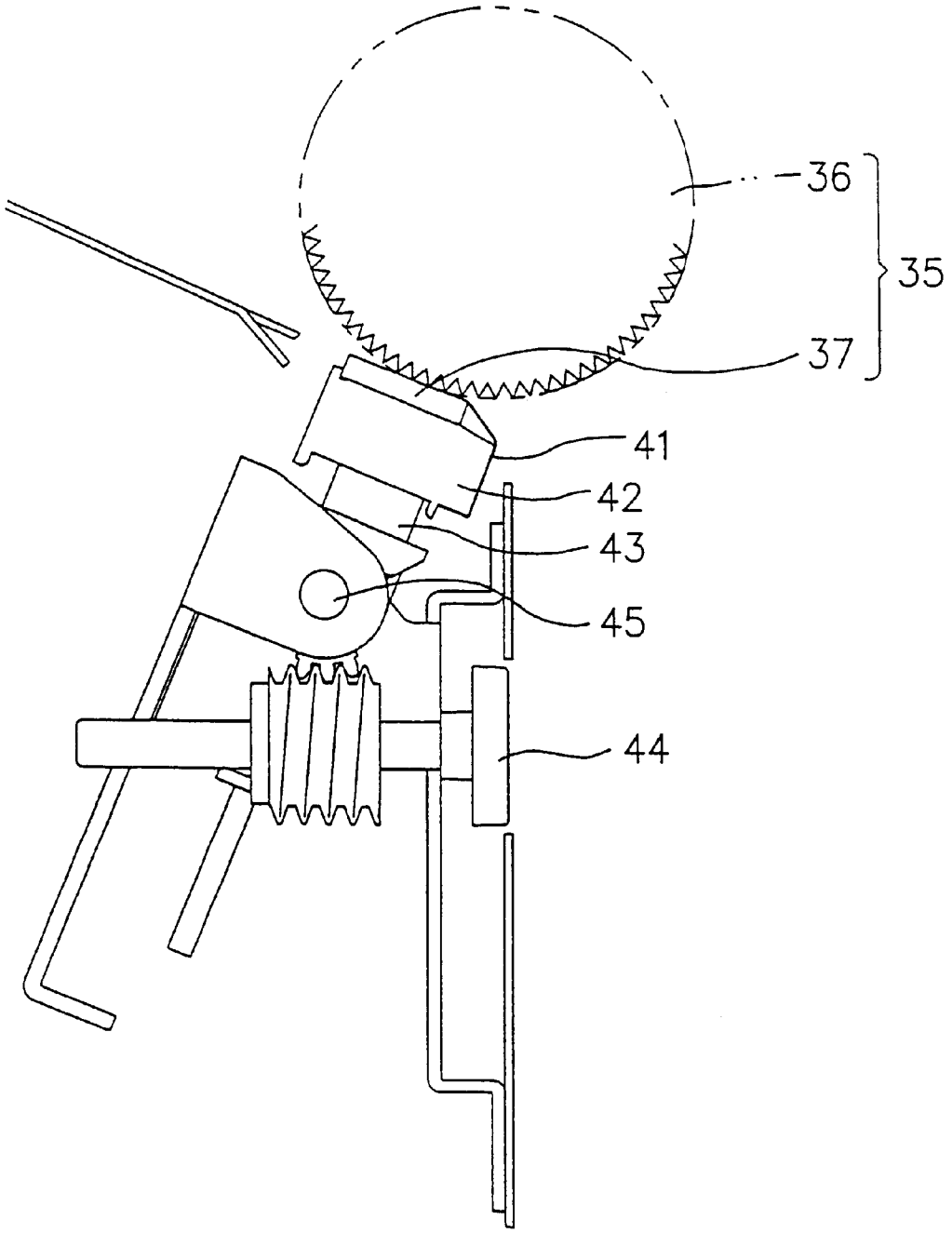
FIG. 3 is a sectional view illustrating separating means of first sheet feeding means of the stencil printing machine.
Figure 4:
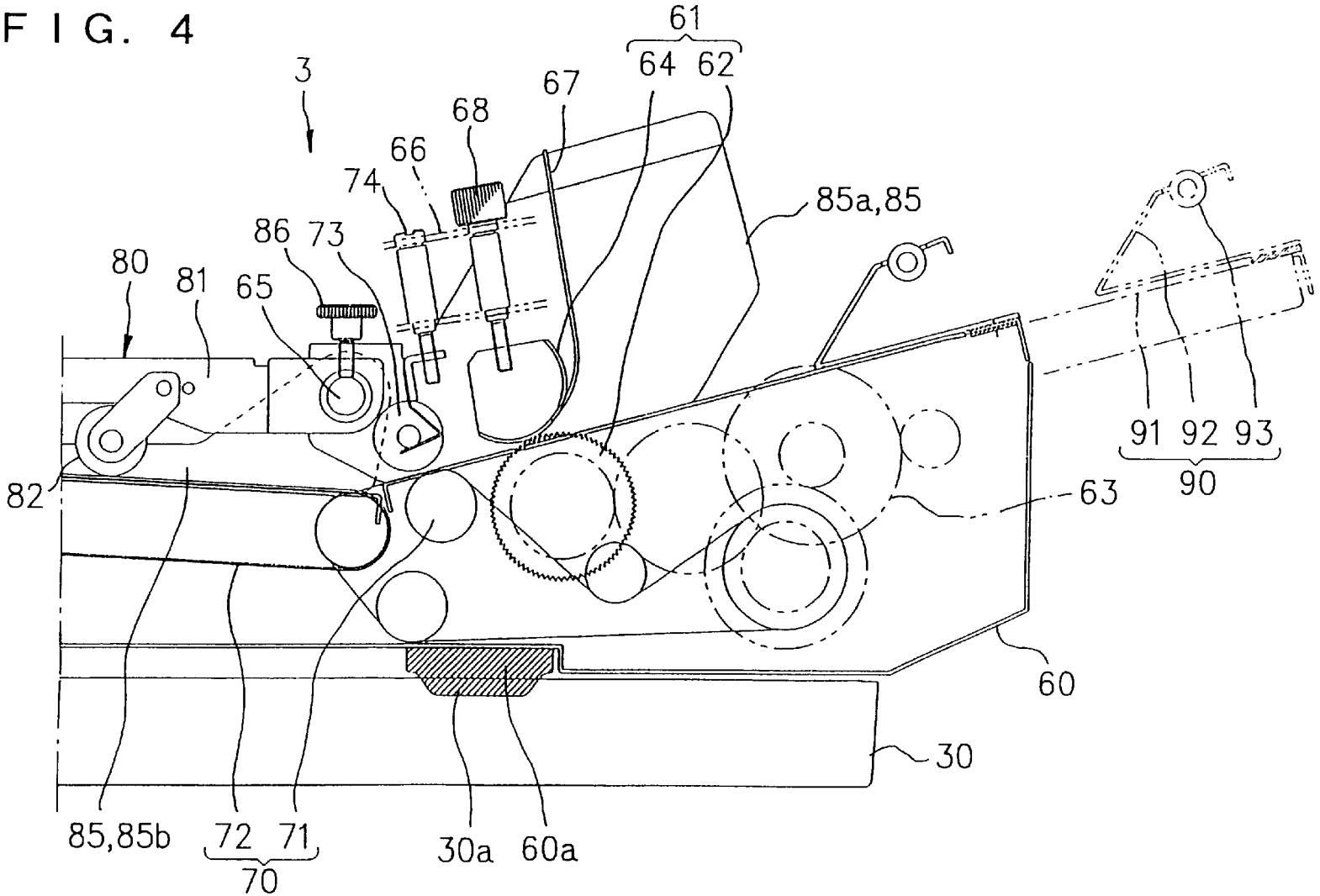
FIG. 4 is a rear half portion of a sectional view illustrating the sheet feeding machine.
Figure 5:
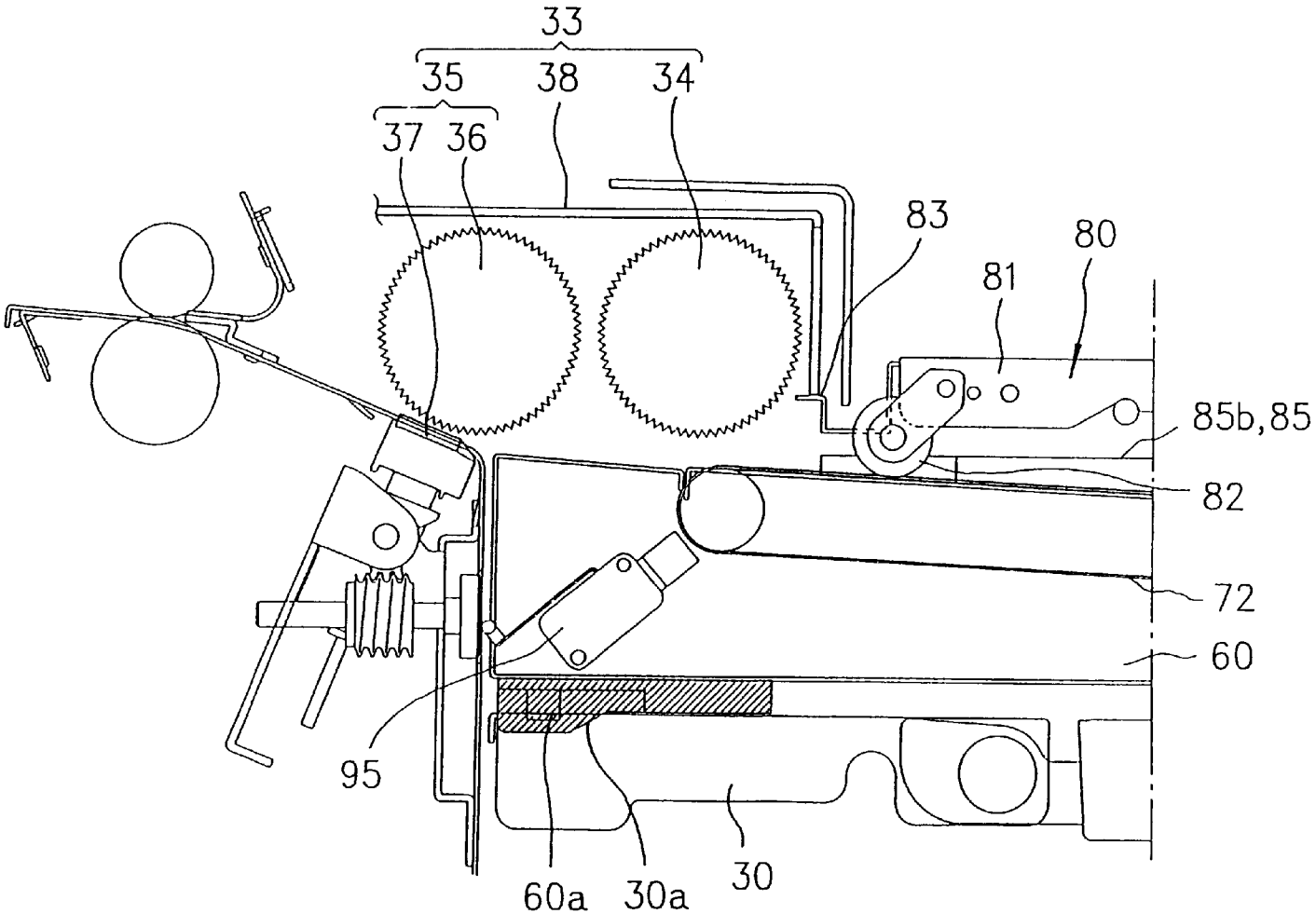
FIG. 5 is a front half portion of a sectional view illustrating the sheet feeding machine.
Figure 6:
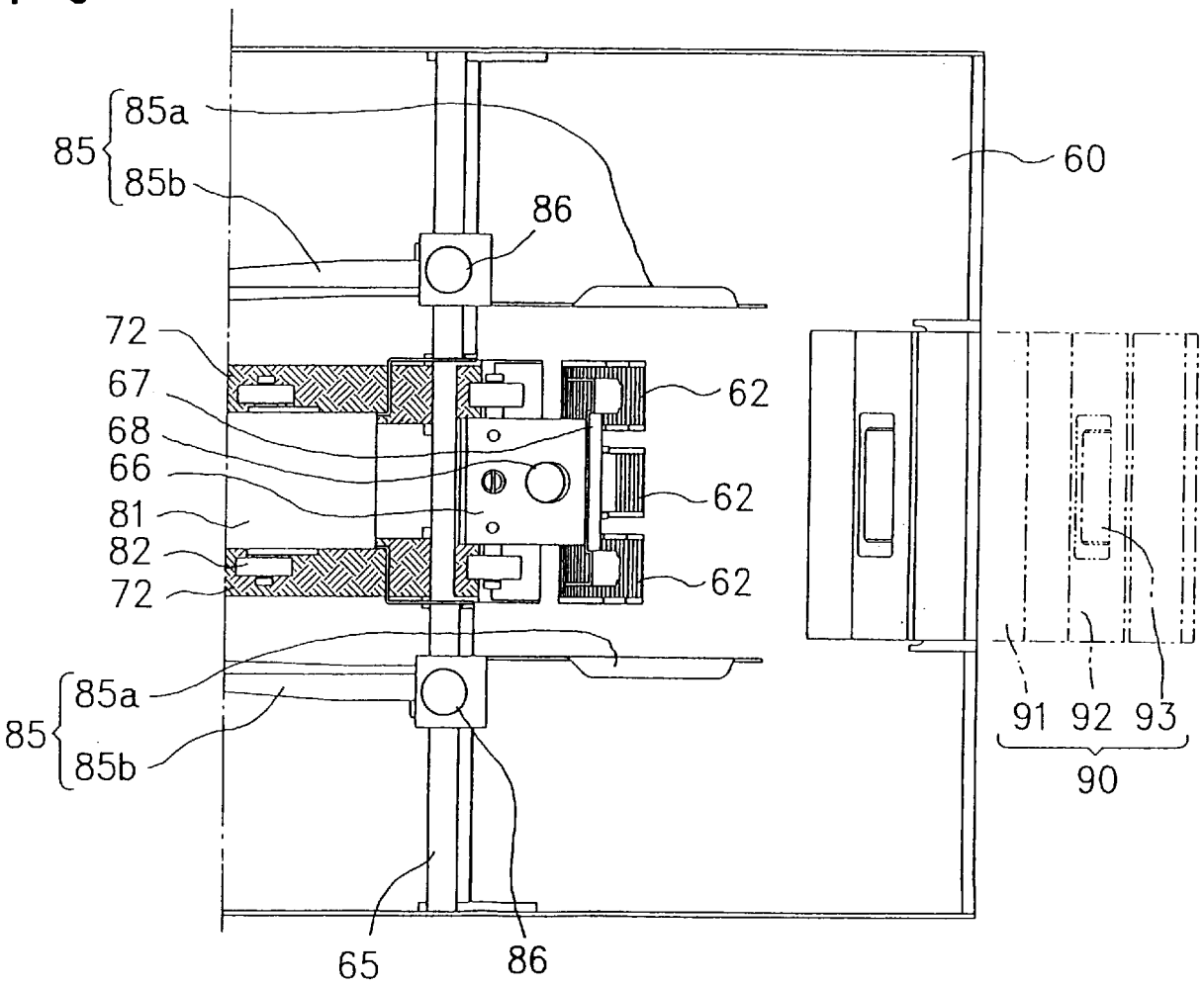
FIG. 6 is a rear half portion of a plane view illustrating the sheet feeding machine.
Figure 7:
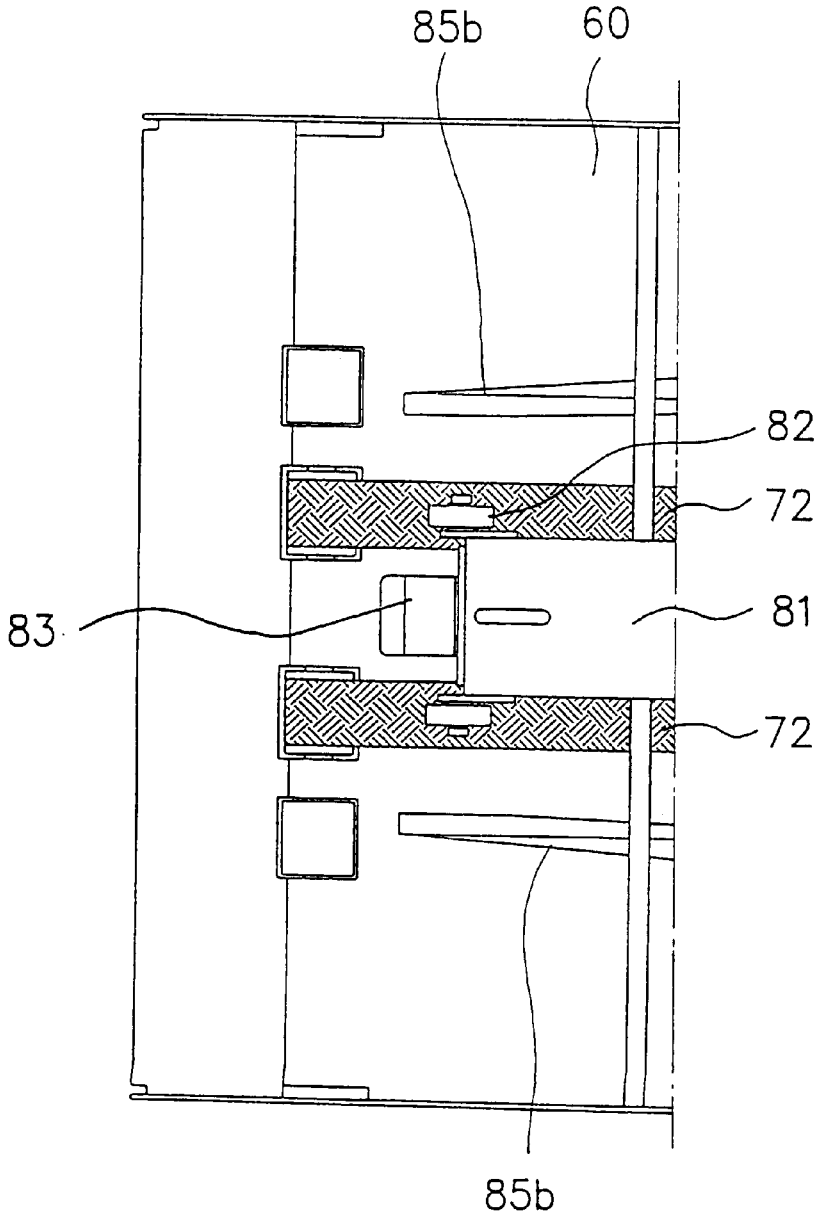
FIG. 7 is a front half portion of a plane view illustrating the sheet feeding machine.

FIG. 3 shows the separating means 35 of the first sheet feeding means 33. As explained before, the separating means 35 has the pick-up roller 35 and the first separating plate 37 contacting the roller. The first separating plate 37 is made of rubber, and the sheet feeding table 30 side thereof is covered by a cover plate 41 made of stainless. The first separating plate 37 is attached to a base block 42, and the base block 42 is fixed to a top end of an adjusting shaft 43. The adjusting shaft 43 has not-shown urging means such as a spring that urges the first separating plate 37 upward to contact the pick-up roller 36. Further, the adjusting shaft 43 with the first separating plate 37 attached thereto can be moved around a supporting axis 45 by turning an adjusting dial 44, so that the tilt angle thereof can be adjusted for adjusting contacting condition of the first separating plate 37 with the pick-up roller 36.

As shown in FIG. 1, a sheet discharging section 50 is situated on the opposite side of the first sheet feeding means 33 relative to the printing drum 10 and the opposing drum 19. The sheet discharging section 50 includes a sheet discharging pinch roller 51, a sheet separating claw 52 for separating the printing sheet from the opposing drum 19, a pair of pinch rollers 54 for sending the printing sheet to a sheet throwing stand 53, and a sheet discharging tray 55 on which the printing sheets as printed are stacked.

The operation of the stencil printing machine 1 as explained will be described.

A stencil sheet as perforated is wound around the outer circumferential surface of the printing drum 10 and attached thereto. The printing drum 10 and the opposing drum 19 starts to rotate. The printing sheets 40 are fed out from the main sheet feeding machine 2 one by one. The printing sheet 40 is conveyed by rotation of the opposing drum 19 while being held by the claw 22 of the opposing drum 19 at a leading end thereof In synchronization with this operation, the inside pusher roller 17 of the printing drum 10 pushes the circumferential wall 13 outwardly. The printing sheet 40 is conveyed while being pinched between the opposing drum 19 and the stencil sheet on an outwardly deformed portion of the printing drum 10, thereby being printed. The printing sheet 10 as printed is separated from the printing drum 10 and discharged to the sheet discharging tray 55 by the sheet discharging section 50.

The stencil printing machine 1 as explained above is for storing such printing-sheets as specified in industrial standards and for printing the same. In the case where special cards or envelopes are printed, the sheet feeding machine 3 of this embodiment, which is of detachable type as explained later, is used.

As shown in FIGS. 4 to 7, the sheet feeding machine 3 has base body 60 on which a plurality of printing materials are stacked. The base body 60 is of an approximately box-form. The base body 60 includes a rear half portion that is fairly inclined, having the printing materials stacked thereon, and a front half portion having a conveying surface along which the printing material is conveyed, so that the printing material is fed into the stencil printing machine. Engaging portions 60*a* are formed on a bottom surface of the base body 60. The engaging portions 60*a* engage with recesses 30*a* formed on an upper surface of the sheet feeding table 30, respectively. The base body 60 can be attached to a predetermined position on the upper surface of the sheet feeding table 30 by engaging the engaging portions 60*a* of the base body 60 with the recesses 30*a* of the sheet feeding table 30, respectively.

Second sheet feeding means 61 is situated to the rear half portion of the base body 60. The second sheet feeding means 61 has separating rollers 62. The separating rollers 62 comprise three rollers coaxially arranged. The separating roller 62 is situated to an approximately center portion of the base body 60 and partially protruding above the conveying surface. The separating roller 62 is connected to a motor 63 situated inside the base body 60, as driving means, by a gear train. The separating roller 62 is connected to a driving shaft thereof by a clutch so that it can feed out the printing material intermittently.

Next, the second sheet feeding means 61 has a second separating plate 64. The second separating plate 64 is situated above the conveying surface of the base body 60, facing the separating roller 62 at a distance therebetween.

That is, a supporting shaft 65 is situated above the center portion of the base body 60 to be perpendicular to a conveying direction of the printing materials. The supporting shaft 65 is connected to both side walls of the base body 60 at both ends thereof respectively. An attachment plate 66 is fixed to a center of the supporting shaft 65 so that it extends rearwards. A collision plate 67 for receiving the printing materials is attached to the attachment plate 66. An upper portion of the collision plate 67 is upright with the conveying surface. A lower end portion of the collision plate 67 that is adjacent to the conveying surface is curved outwardly toward the conveying surface.

The second separating plate 64 is only vertically movably attached to the attachment plate 66. The second separating plate 64 has a separating surface that is curved outwardly like a surface of a cylinder. The second separating plate 64 is positioned so that the separating surface thereof approximately coincide with a surface of the collision plate 67. The separating surface is covered with frictional material such as rubber.

Further, an adjusting screw 68 as adjusting means is situated downward in the attachment plate 66. The adjusting screw 68 can turn in the attachment plate 66, but it cannot move in axial direction thereof A front end of the adjusting screw 68 is screwed into the second separating plate 64 that is allowed to move only vertically relative to the attachment plate 66. Therefore, the second separating plate 64 is moved vertically relative to the attachment plate 66 by feeding force of the adjusting screw 68 when the adjusting screw 68 is turned. As a result, a distance between the second separating plate 64 and the separating roller 62 can be adjusted.

A conveying mechanism 70 for the printing materials is situated in the front half portion of the base body 60. The conveying mechanism 70 has a conveying roller 71 situated adjacent to the second separating roller 62 and a pair of belts 72. The conveying mechanism 70 is driven by an interlocking mechanism of the second separating roller 62 while being connected thereto by a belt, further conveying the printing material fed from between the separating roller 62 and the second separating plate 64. The conveying mechanism 70 is driven continuously during intermittent operation of the second separating roller 62. An opposing roller 73 is situated above the conveying roller 71. The opposing roller 73 is connected to the attachment plate 66, moving vertically by turning an adjusting screw 74 attached to the attachment plate 66. Pressure exerted on the printing material between the opposing roller 73 and the conveying roller 71 can be adjusted by operating the adjusting screw 74.

Pressing means 80 for pressing the printing material is situated above the conveying mechanism 70. The pressing means 80 has a plate member 81 pivotally attached to a supporting shaft 65 and four pressing rollers 82 attached to the plate member 81. Each belt 72 of the conveying mechanism 70 corresponds to a pair of front and rear rollers 82. The pressing means 80 presses the printing material against the conveying mechanism 70 by its self-weight, thereby stabilizing the conveyance.

A pair of side plates 85 is adjustably situated to the conveying surface of the base body 60. The side plate 85 comprises a plate 85*a* situated to the rear half portion of the base body 60 for holding the printing material stacked there and a plate 85*b* situated to the front half portion of the base body 60 for guiding the printing material conveyed. The plate 85*a* is higher than the plate 85*b*, since the plate 85*a* is required to hold the stacked printing material. Both side plates are slidably fitted on the supporting shaft 65 and fixed thereto by screws 86.

Supporting means 90 of printing materials is situated to the conveying surface of the base body 60 before the plates 85*a*. The supporting means 90 has a base plate 91 capable of drawing backward in the conveying surface of the base body 60, a plate member 92 attached to the base plate 91 at an angle, and a roller 93 situated to an upper part of the plate member 92. The supporting means 90 lifts up a rear portion of the printing materials superimposed thereon, so that the printing materials can be supported with small friction acting between a bottom surface of the printing materials and the conveying surface. The roller 93 decreases the friction when the printing materials are conveyed by being rotated. The base plate 91 is drew backward to extend for use when the printing material is long, and used as being stored when the printing material is short.

A set switch 95 is situated to a front end of the base body 60. When the sheet feeding machine 3 is regularly attached to the predetermined position of the sheet feeding table 30, the set switch 95 outputs a signal while being operated by the stencil printing machine 1. By using this signal, the sheet feeding machine 3 can be confirmed to regularly attached to the predetermined position on the sheet feeding table 30. Further, the motor 63 can start driving only when the set switch turned on. Further, control means of the stencil printing machine 1 can be electrically connected to the sheet feeding machine 3 only when the set switch turned on.

An operating member 83 is attached to a front end of the plate member 81 of the pressing means 80. When the sheet feeding machine 3 is regularly attached to the sheet feeding table 30, and further the sheet feeding table 30 is positioned to a regular position where the sheet feeding machine 3 conducts sheet-feeding, the operating member 83 lifts up the casing 38 of the scraper roller 34 situated on the stencil printing machine 1 side, thereby allowing the scraper roller to leave the sheet conveying surface. That is, since sheet-feeding function of the first sheet feeding means 33 on the stencil printing machine 1 side is not necessary when the sheet feeding machine 3 is used, then the operating means 83 stops sheet-feeding function of the first sheet feeding means 33 on the stencil printing machine 1 when the sheet feeding machine 3 is situated to the position for use.

Figure 10:
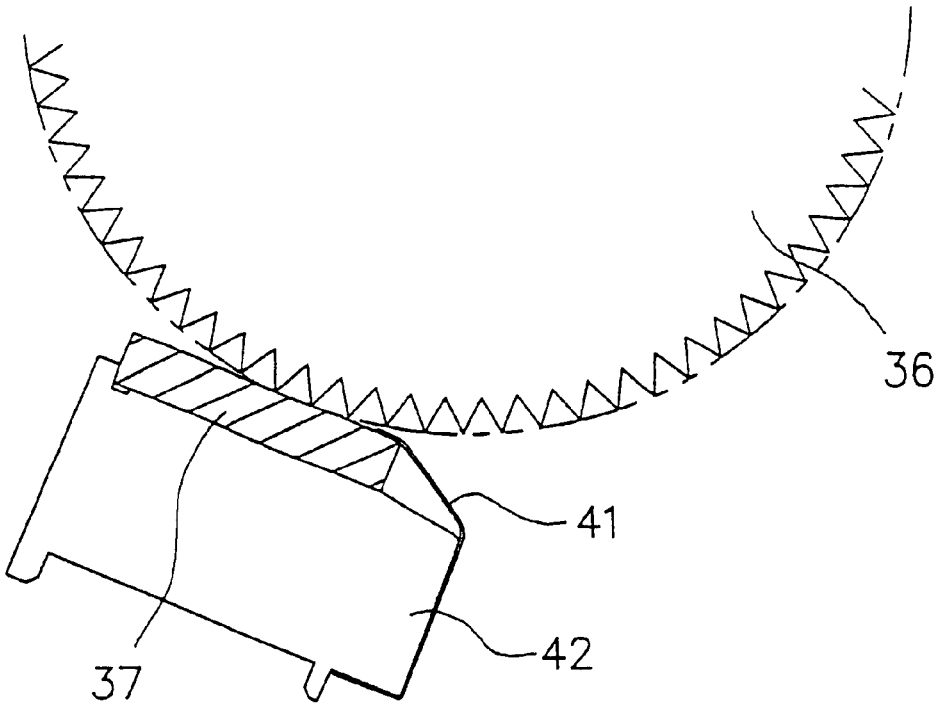
FIG. 10(*a*) is a view illustrating adjustment of tilt angle of a first separating plate of the separating means in the stencil printing machine.
Figure 10:
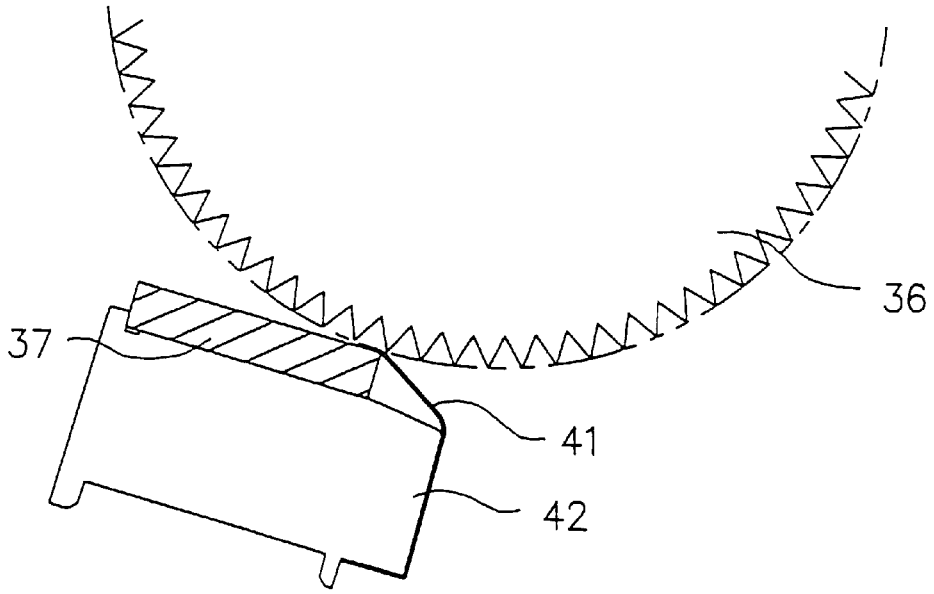

Then, the first separating plate 37 of the first sheet feeding means 33 of the stencil printing machine 1 is so adjusted that the angle of the separating plate relative to the sheet feeding direction is arranged to be small. Namely, when the first sheet feeding means 33 normally function, the rubber of the first separating plate 37 contacts the pick-up roller 36 as shown in FIG. 10(*a*). When the first sheet feeding means 33 is not normally used, the angle of the separating plate relative to the sheet conveying direction is arranged to be small as shown in FIG. 10(*b*), that is, surface of the rubber of the first separating plate 37 approaches horizontal; therefore, the pick-up roller 36 does not contact the rubber of the first separating plate 37 but contacts the cover plate 41 made of stainless. In this state, the pick-up roller 36 and the first separating plate 37 does not function as the separating means 35, bun only function as a conveying means for just forwarding the printing materials fed thereto.

Thus, the first separating means 33 on the stencil printing machine 1 simply function as the conveying means while halting the sheet feeding function thereof when the sheet feeding machine 3 is used. Operation for this can be conducted automatically by mounting the sheet feeding machine 3 on the sheet feeding table 30, or can be conducted just manually.

Next, operation of the present sheet feeding machine will be explained.

The first separating plate 37 is arranged to be approximately horizontal by turning the adjusting dial 44, thereby halting the separating function. The printing sheets stacked on the sheet feeding table 30 are taken away. Next, the sheet feeding machine 3 is placed on the predetermined position on the sheet feeding table 30 of the stencil printing machine 1. Switching of the set switch 95 of the sheet feeding machine confirms that the sheet feeding machine 3 is properly attached to the sheet feeding table 30. Further, on the basis of the signal outputted from the set switch 95, the stencil printing machine 1 and the sheet feeding machine 3 are arranged in such a manner that they can be driven in synchronization with each other. After that, every operation required can be conducted from a not-shown operating panel on the stencil printing machine 1.

Figure 8:
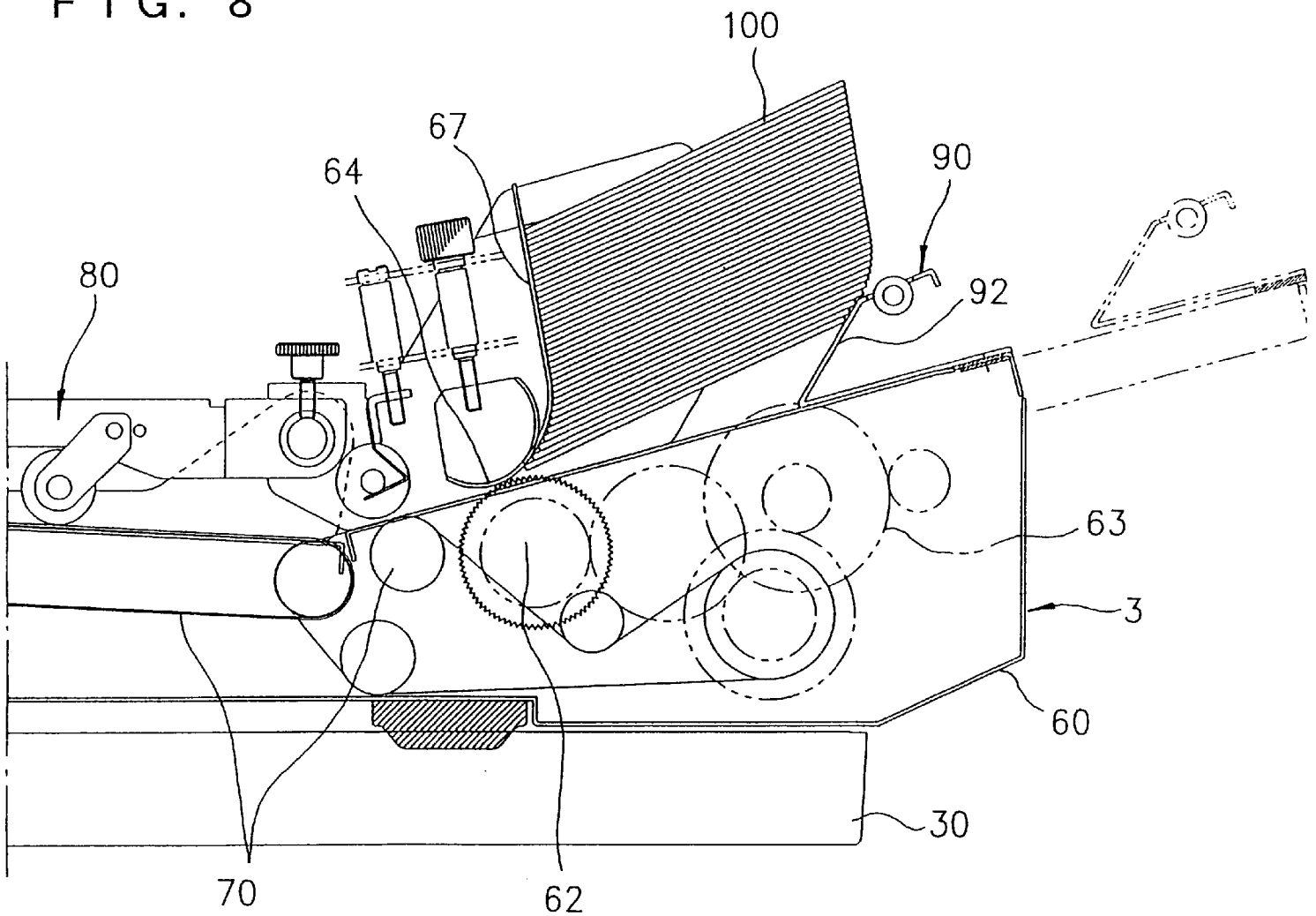
FIG. 8 is a rear half portion of a sectional view illustrating the sheet feeding machine with printing materials stacked thereon.
Figure 9:
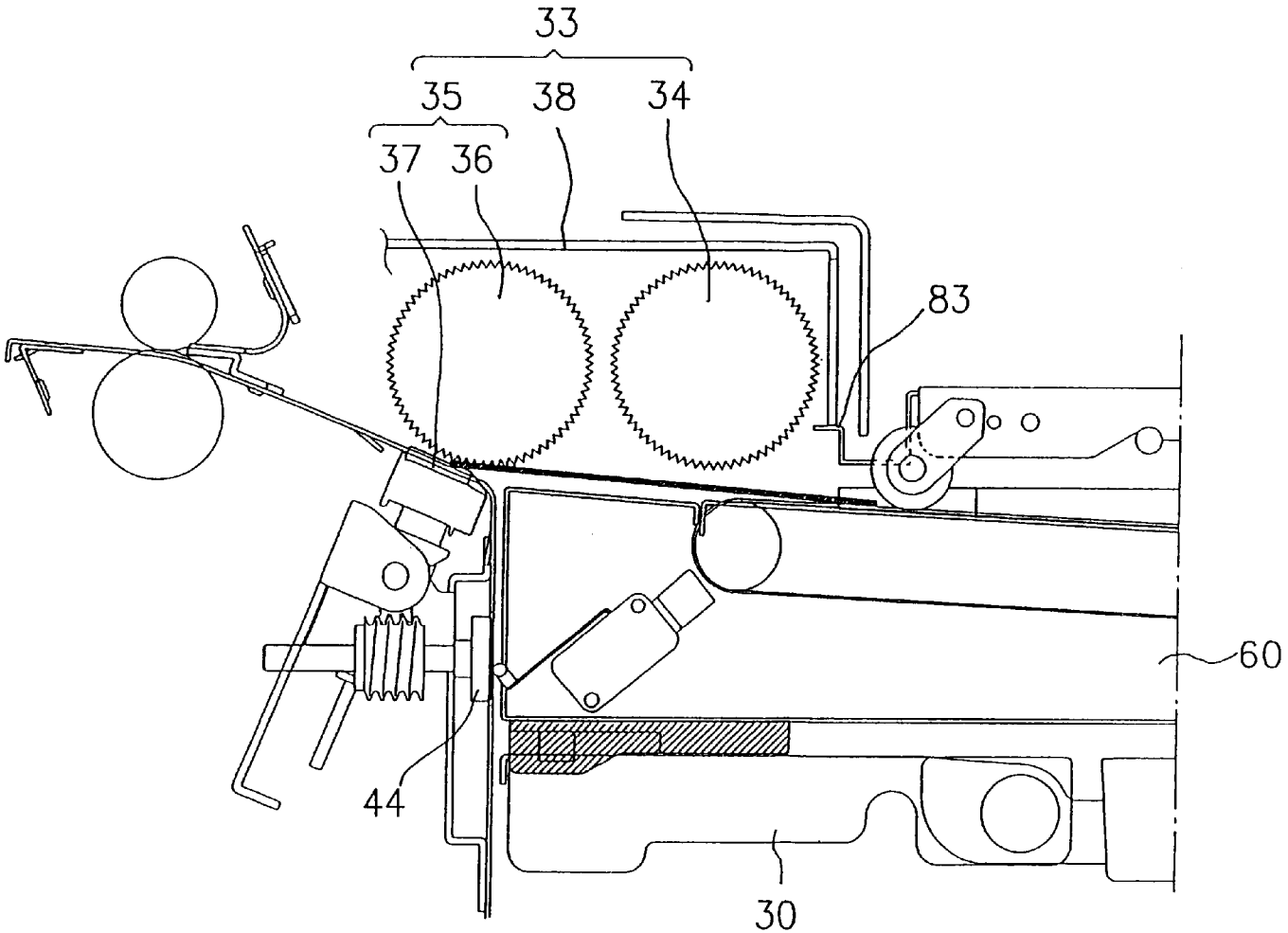
FIG. 9 is a front half portion of a sectional view illustrating the sheet feeding machine conveying the printing material.

As shown in FIGS. 8 to 9, a plurality of the printing materials 100 is stacked on the supporting means 90.

Since the printing materials 100 are propped against the inclined plate member 92, a bottom printing material 100 does not contact the conveying surface of the base body 60. Accordingly, the bottom printing material 100 can be fed out with less friction. Further, the stacked printing materials 100 are inclined on the base body 60 and gradually shift along the curved surface of the collision plate 67, so that the lower material positions more forwards. Accordingly, the printing materials 100 are easily separated from each other and fed out one by one from the lowest-positioned material.

The distance between the second separating plate 64 and the separating roller 62 is arranged to be fairly larger than the thickness of the printing material 100. Unlike the conventional separating means 35 where the pick-up roller 36 contacts the first separating plate 37 with a rather large pressure, pressure does not act on the printing material 100, the printing material 100 entering in an inclined direction is conveyed by contact with the separating roller 62. Therefore, the printing material 100 does not tend to be damaged.

Printing operation is started when a print start key on the operating panel of the stencil printing machine 1 is depressed. Firstly, the sheet feeding table 30 moves upward, thereby setting the sheet feeding machine 3 at the regular position for sheet feeding. Namely, when the sheet feeding machine 3 reaches the regular sheet feeding position upon the upward moving of the sheet feeding table 30, the operating means 83 of the sheet feeding machine 3 lifts up the casing 38 of the scraper roller 34 disposed on the stencil printing machine 1 side, thereby allowing the separating roller to leave the conveying surface of the printing material 100. This means that sheet feeding function of the first sheet feeding means 33 of the stencil printing machine 1 is halted, and that the casing 38 operates the positioning sensor 39 (switch) while being lifted up so as to stop the sheet feeding table 30.

The motor 63 is energized, and the clutch attached to the driving shaft of the separating roller 62 is released. Thereby, the separating roller 62 begins to rotate intermittently in synchronization with printing operation of the stencil printing machine 1. The stacked printing materials 100 are successively fed out from the lowest material. The lowest printing material 100 is pressed downwards by the other printing materials stacked thereon. The pressing power acts in a diagonally downward direction in which the lowest printing material 100 is drawn; therefore, power required to draw the printing material by using the separating roller 62 is relatively small than that of the conventional machine. Accordingly, the printing material 100 does not tend to be damaged also owing to this respect.

The one printing material 100 is separated from the others between the separating roller 62 and the second separating plate 64 and conveyed by the conveying means 70. The printing material 100 is pressed against the conveying means 70 by the self-weight of the pressing means 80, thereby being stably conveyed.

On the stencil printing machine 1 side, the pick-up roller 36 contacts the first separating plate 37. The printing material 100 temporarily stop between the pick-up roller 36 and the cover plate 41 after being conveyed. Further, the printing material 100 is fed into the stencil printing machine 1 by the pick-up roller 36 driven according to printing timing of the stencil printing machine 1, and then the printing material is printed there. That is, the pick-up roller 36 and the first separating plate 37 on the stencil printing machine side halt separating function thereof but functions as the conveying means for conveying the printing material 100 when the sheet feeding machine 3 is used.

Additionally, in this embodiment, the adjusting dial 44 of the stencil printing machine 1 is manually operated to set the first separating plate 37 to be approximately horizontal, so that the pick-up roller 36 and the cover plate 41 of the first separating plate 37 are adjusted to contact with each other; however, it is also preferable that an axis of the adjusting dial 44 is connected to a motor, and the adjusting operation is automatically conducted when the motor is energized by the signal outputted from the set switch 95.

It is difficult to stably convey every kind of printing sheet by sheet feeding means equipped with a conventional printer. However, according to the present invention, special printing sheets can be stably fed out from a bottom sheet into the printer by optionally attaching the sheet feeding machine of the present invention to the sheet feeding means of the printer.

What is claimed is:

1. A sheet feeding machine comprising:

a sheet feeding table which is vertically movable and capable of supporting a plurality of first recording sheets thereon, first sheet feeding means movably situated above said sheet feeding table, said first sheet feeding means feeding said first recording sheets successively from a topmost sheet as said sheet feeding table with said first recording sheets moves upward, a base body detachably attached to said sheet feeding table, said base body supporting a plurality of second recording sheets thereon, and second sheet feeding means situated on said base body and feeding said second recording sheets successively from a bottommost sheet so that when said base body is attached to said sheet feeding table, said second recording sheet is fed by said second sheet feeding means and is transferred further by said first feeding means as conveying means.

2. A sheet feeding machine as claimed in claim 1, wherein said first sheet feeding means comprises fetching means for fetching said first recording sheets and separating means situated adjacent to said fetching means for separating said topmost sheet from said first recording sheets fetched by said fetching means to feed said topmost sheet so that said fetching means moves upward to halt fetching and said separating means halts separating in the case where said first sheet feeding means is used as said conveying means.

3. A sheet feeding machine as claimed in claim 1, wherein said first sheet feeding means comprises a first roller for fetching said first recording sheets including said topmost sheet while contacting therewith, a second roller for separating said topmost sheet from said first recording sheets fetched by said first roller to feed said topmost sheet, and a separating member contacting said second roller, a contact condition of said separating member with said second roller being adjustable so that in the case where said first sheet feeding means is used as said conveying means, said first roller moves upward not to contact said second recording sheets on said base body and said separating member halts separating.

4. A sheet feeding machine as claimed in claim 3, wherein said separating member is a first separating plate, an angle of said first separating plate relative to said second roller being adjustable, in the case where said first sheet feeding means is used as said conveying means, said first separating plate together with said second roller functions as said conveying means with said angle adjusted relatively small against a feeding direction of said second recording sheet in comparison with the case where said first sheet feeding means feeds said first recording sheets.

5. A sheet feeding machine as claimed in claim 1, wherein said second sheet feeding means comprises a separating roller partially protruding from a conveying surface on said base body for conveying said second recording sheet and a second separating plate vertically movably situated above said separating roller.

6. A sheet feeding machine as claimed in claim 5, wherein said second separating plate has a separating surface made of a frictional material and curved outwardly toward said separating roller.

7. A sheet feeding machine as claimed in claim 5, wherein a distance between said second separating plate and said separating roller is fairly larger than the thickness of said second recording sheet.

8. A sheet feeding machine as claimed in claim 5, further comprising supporting means situated on said base body for supporting said second recording sheets thereon so that said second recording sheets are spaced away from said conveying surface.

9. A sheet feeding machine as claimed in claim 5, further comprising conveying mechanism for conveying said second recording sheet fed from said separating roller while being driven by in association with said separating roller, and pressing means situated vertically movably above said conveying mechanism for pressing said second recording sheet against said conveying mechanism with its self-weight.

10. A sheet feeding machine as claimed in claim 5, further comprising a sensor situated adjacent to said sheet feeding table, said sensor outputting a stop signal for said sheet feeding table to stop while being operated by said first sheet feeding means moved by said first recording sheets stacked on said sheet feeding table when said sheet feeding table moves upwards so that said base body attached to said sheet feeding table is vertically positioned when a part of said base body moves said first sheet feeding means thereby operating said sensor as said sheet feeding table moves upwards.

11. A combination comprising a main sheet feeding machine for feeding first recording sheets and a sub sheet feeding machine detachably attached to said main sheet feeding machine for feeding second recording sheets, said main sheet feeding machine including:

a sheet feeding table which is vertically movable and capable of supporting said first recording sheets thereon, and first sheet feeding means situated above said sheet feeding table, said first sheet feeding means being capable of feeding said first recording sheets successively from a topmost sheet as said sheet feeding table with said first recording sheets stacked thereon moves upward, said sub sheet feeding machine including:

a base body detachably attached to said sheet feeding table, said base body supporting said second recording sheets thereon, and second sheet feeding means situated on said base body and feeding said second recording sheets successively from a bottommost sheet so that when said base body is attached to said sheet feeding table, said first feeding means operates as conveying means for conveying said second recording sheets fed by said second sheet feeding means.

* * * * *